US006172651B1

(12) United States Patent
Du

(10) Patent No.: US 6,172,651 B1
(45) **Date of Patent: *Jan. 9, 2001**

(54) DUAL-BAND WINDOW MOUNTED ANTENNA SYSTEM FOR MOBILE COMMUNICATIONS

(75) Inventor: Xin Du, Bartlett, IL (US)

(73) Assignee: Larsen Electronics, Inc., Vancouver, WA (US)

( * ) Notice: Under 35 U.S.C. 154(b), the term of this patent shall be extended for 0 days.

(21) Appl. No.: 08/951,428

(22) Filed: Oct. 16, 1997

Related U.S. Application Data

(63) Continuation-in-part of application No. 08/740,204, filed on Oct. 24, 1996.

(60) Provisional application No. 60/008,071, filed on Oct. 25, 1995.

(51) Int. Cl.[7] ..... H01Q 1/50; H01Q 1/32

(52) U.S. Cl. ..... 343/850; 343/713; 343/715; 333/109

(58) Field of Search ..... 333/116, 109, 333/24 C; 343/713, 715, 850

(56) References Cited

U.S. PATENT DOCUMENTS

| | | | |
|---|---|---|---|
| Re. 33,743 | 11/1991 | Blaese . | |
| 2,026,652 | 1/1936 | Ponte . | |
| 2,206,820 | 7/1940 | Mydlil . | |
| 2,559,613 | 7/1951 | Halstead . | |
| 2,829,367 | 4/1958 | Rychlik . | |
| 3,364,487 | 1/1968 | Maheux . | |
| 3,657,652 | 4/1972 | Smith . | |
| 4,001,834 | 1/1977 | Smith . | |
| 4,028,704 | 6/1977 | Blass . | |
| 4,089,817 | 5/1978 | Kirkendall . | |
| 4,238,799 | 12/1980 | Parfitt . | |
| 4,492,939 * | 1/1985 | Burns | 333/116 |
| 4,621,243 | 11/1986 | Harada . | |
| 4,658,259 | 4/1987 | Blaese . | |

(List continued on next page.)

FOREIGN PATENT DOCUMENTS

| | | |
|---|---|---|
| 3537107 | 10/1985 | (DE) . |
| 458 592 A2 | 11/1991 | (EP) . |
| 1203227 | 8/1958 | (FR) . |
| 1227757 | 6/1959 | (FR) . |
| 1-36128 | 2/1989 | (JP) . |
| 1-77230 | 3/1989 | (JP) . |
| 6303016 | 10/1994 | (JP) . |

OTHER PUBLICATIONS

Fink, Electronics Engineers' Handbook, McGraw–Hill Book Company, 1st Ed., 1975, p. 3–3.

Johnson, Transmission Lines and Networks, McGraw–Hill Book Company, 1950, p. 239.

Ora Electronics brochure, "Static Noise and Cross Talk When Using Your Portable Cellular Telephone Inside a Car?" 1990.

(List continued on next page.)

*Primary Examiner*—Don Weng
*Assistant Examiner*—Jennifer H. Malos
(74) *Attorney, Agent, or Firm*—Klarquist Sparkman Campbell Leigh & Whinston, LLP

(57) ABSTRACT

A low cost glass mount vehicle antenna system utilizes, in a preferred embodiment, an over-coupled quasi-TEM mode transmission line coupler having two simple stamped or printed plates stacked over an L shape internal ground plane. The two conductive plates are located on opposite sides of the glass. With proper open circuit terminations on two of the four coupler ports, the backwards and forward coupling signals are redirected/combined and are effectively fed diagonally between the other two ports, thereby achieving through-glass coupling. The over-coupling achieves this efficient through-glass coupling effect at two spaced-apart frequencies (e.g. 800 MHz and 1800 MHz). The coupler is of a low impedance type and can be used with a variety of collinear array and elevated-feed antennas. It features high efficiency, low backwards radiation, and mechanical simplicity.

20 Claims, 7 Drawing Sheets

U.S. PATENT DOCUMENTS

| | | | | |
|---|---|---|---|---|
| 4,692,770 | | 9/1987 | Kadokura . | |
| 4,764,773 | | 8/1988 | Larsen et al. . | |
| 4,779,098 | | 10/1988 | Blaese . | |
| 4,785,305 | | 11/1988 | Shyu . | |
| 4,794,319 | | 12/1988 | Shimazaki . | |
| 4,804,969 | | 2/1989 | Blaese . | |
| 4,825,217 | | 4/1989 | Choi . | |
| 4,839,660 | | 6/1989 | Hadzoglu . | |
| 4,850,035 | | 7/1989 | Schiller . | |
| 4,857,939 | | 8/1989 | Shimazaki . | |
| 4,862,183 | | 8/1989 | Blaese . | |
| 4,872,630 | | 10/1989 | Cooper . | |
| 4,931,806 | * | 6/1990 | Wunderlich | 343/715 |
| 4,939,484 | | 7/1990 | Harada . | |
| 4,939,524 | | 7/1990 | Blasese . | |
| 4,992,800 | | 2/1991 | Parfitt . | |
| 5,017,934 | | 5/1991 | Blaese . | |
| 5,023,622 | | 6/1991 | Blaese . | |
| 5,027,128 | | 6/1991 | Blaese . | |
| 5,041,838 | | 8/1991 | Liimatainen et al. . | |
| 5,059,971 | | 10/1991 | Blaese . | |
| 5,099,252 | | 3/1992 | Bryant et al. . | |
| 5,451,966 | | 9/1995 | Du et al. . | |
| 5,471,222 | | 11/1995 | Du . | |
| 5,557,290 | * | 9/1996 | Watanabe | 343/713 |
| 5,565,877 | * | 10/1996 | Du et al. | 343/713 |
| 5,742,255 | * | 4/1998 | Afendras | 343/713 |
| 5,841,328 | * | 11/1998 | Hayashi | 333/116 |

OTHER PUBLICATIONS

Ora Electronics, "Passave Repeater for Portable Cellular Telephones," 1990, 5 page publication.

dbMobile Brochure, "Active Link Repeater Installation Manual," 1992, 14 pages.

Gianola et al., "General Computation of Co–Polar and Cross–Polar Components of Arbitrary Aperture Coupled Multilayered Microstrip Antennas," *Antennas and Propagation,* Apr. 4–7, 1995, Conference Publication No. 407, pp. 29–33, IEEE 1995.

Kamiya, et al., "Design for Dual–Frequency Microstrip Antenna Using Annular Slot Aperture Coupling," 91/CH3036–1/0000–1118, pp. 1118–1121, IEEE 1991.

Ikrath, et al., "Slot–Coupled Vehicles (Trucks, Tanks, and Jeeps) Performing as VHF Antennas," Communications/Automatic Data Processing Laboratory, U.S. Army Electronics Command, Fort Monmouth, NJ, Ap–S Session 12, 0940, pp. 387–390.

Pozar, "Improved Coupling for Aperture Coupled Microstrip Antennas," *Elec. Lett.* 27, pp. 1129–1131 (Jun. 1991).

Saed, "Slot–Coupled Circular Microstrip Antenna Having a Symmetric Radiation Pattern," Department of Electrical Engineer, State University of New York, 0–7803–1246–5/93, pp. 1204–1206, IEEE 1993.

Takeuchi, et al., "Characteristics of a Slot Coupled Microstrip Antenna Using High–Permittivity Feed Substrate," *Electronics and Communications in Japan,* Part 1, 78:3, pp. 85–94 (1995).

* cited by examiner

| 1: Mkr (MHz) | | | 2: Mkr (MHz) | | dB |
|---|---|---|---|---|---|
| 1: | 824.00 | 1.84 | 1: | 824.00 | -77.89 |
| 2: | 896.00 | 1.94 | 2: | 896.00 | -79.17 |
| 3: | 1850.00 | 1.89 | 3: | 1850.00 | -75.55 |
| 4> | 1989.34 | 1.51 | 4> | 1989.34 | -75.93 |

| 1: Mkr (MHz) | | | 2: Mkr (MHz) dB |
|---|---|---|---|
| 1: | 1850.00 | 1.42 | |
| 2: | 1920.00 | 1.08 | |
| 3: | 1990.00 | 1.27 | |
| 4> | 2100.00 | 1.91 | |

DUAL-BAND WINDOW MOUNTED ANTENNA SYSTEM FOR MOBILE COMMUNICATIONS

RELATED APPLICATION DATA

This application is a continuation-in-part of my copending application Ser. No. 08/740,204, filed Oct. 24, 1996, which claims priority from my provisional application Ser. No. 60/008,071, filed Oct. 25, 1995. The disclosures of these prior applications are incorporated by reference.

BACKGROUND OF THE INVENTION

The present invention relates generally to the transmission of radio frequency signals through a dielectric wall (e.g. a vehicle window) and is illustrated in the context of a dual-band, glass mount mobile antenna system.

Window mounted antennas have been welcome for many years in mobile radio links, especially in 800 MHz cellular telephone service (sometimes known by the acronym "AMPS") due to their obvious advantages to the consumer. These advantages include the ease of installation and the fact that it is not necessary to drill a hole in the vehicle, which would detract from its value. Others include enhancing the signal strength for better communication quality, and moving radiation outside the vehicle. Much effort has been devoted to designing effective window mounted antenna systems for mobile radio links.

A new type of cellular service, known in the United States as PCS, is growing in popularity. This service occupies frequencies between 1500 and 2000 MHz. (In the United States, the PCS band is at 1900 MHz. In Europe this service (termed PCN) is at 1800 MHz. In Japan this service (termed PHS) is at 1500 MHz.). This alternate cellular service creates a potential compatibility problem with the existing, well-established 800 MHz cellular infrastructure. Many effort have been made to address these comparability issues. The most effective solution seems to be the emergence of multi-mode, multi-band handsets that automatically adapt to the service available in a given area. For example, Qualcomm offers a dual-band, dual mode phone known as the QCP-2700, which provides service over both the 800 MHz AMPS band and the 1900 MHz CDMA PCS band. Ericsson has similar offerings, such as its models PD 328 and PD 398, which each provides both AMPS and PCS service.

These dual-band handsets pose a significant engineering challenge, namely the design of a single antenna that provides good performance at both the AMPS and PCS bands. This challenge is compounded when the antenna is vehicle-mounted and fed through-glass. The through-glass coupling system must provide high efficiency coupling (and in some instances antenna matching) at both AMPS and PCS frequencies. Moreover, the bandwidth required at each band is large (e.g. up to 11% in the PCS bands), posing a further engineering obstacle.

A variety of through-glass feed techniques are known, as illustrated by the cited patents. Many are capacitively-coupled systems. Examples include U.S. Pat. No. 4,089,817 (Kirkendall, 1978), U.S. Pat. No. 4,839,660 (Hadzoglou, 1989), U.S. Pat. No. 4,992,800 (Parfitt), U.S. Pat. No. 4,857,939 (Shimazaki) and U.S. Pat. No. 4,785,305 (Shyu). In addition to capacitive coupling, these systems also generally employ LC impedance matching networks.

There are several problems with the foregoing designs. First the capacitive coupling patches cannot be large in comparison with the operating wavelength. Therefore; high impedance coupling (several hundred ohms) cannot be avoided. This leads to high loss due to the leakage of electrical field at high frequencies. Also, at high frequency bands like PCN/PCS, even a small patch no longer behaves as a lumped capacitor element. Due to the thickness of vehicle glass and various stray capacitances, such capacitive coupling circuits can bypass the signal and make it more difficult to match the (typically) high impedance of the antenna to a 50 ohm system. Additionally, the high impedance coupling creates a moisture sensitive structure. U.S. Pat. No. 4,764,773 (Larsen, 1988) describes a better coupling structure to improve performance in the presence of moisture, but it is still subject to the patch size limitation.

Design of a vehicle-mounted radiator also poses difficulties at PCS frequencies. Collinear array whips are desirable for mobile service due to their gain in the vertical plane. However, such whips do not have uniform current distribution. The lower section of the array has the highest current and produces the strongest radiation. But in most vehicle mounting arrangements the lower section of the whip is blocked by the vehicle roof, causing severe pattern distortion and deep nulls. This situation becomes worse at the 1.5–2 GHz PCN/PCS bands simply because the length of radiator is only half that at the 800 Mhz hand due to the doubling of the frequency.

Elevated-feed whips are sometimes employed to avoid the pattern distortion caused by vehicle roof blockage of radiation. But elevated-feed antennas are not readily matched for broadband operation (i.e. 11% for DCS-1800). Moreover, many such antennas, employing decoupling sleeve or slots, have low impedance feeds (e.g. 50 ohms). High impedance capacitive-feed systems thus pose large impedance transitions. Impedance transformation at PCS frequencies by use of conventional LC circuits is very inefficient due to the high loss of such circuits at these high frequencies.

U.S. Pat. No. Re.33,743 (Blaese) proposes a capacitively coupled antenna system for coupling a coaxial cable through glass to a low impedance quarter-wave whip. But in the PCS bands, the suggested antenna is only 1.7" long. Again, this is completely below the roof line of vehicle, causing severe pattern distortion and deep nulls.

To avoid some of the problems associated with capacitive coupling, a coupling arrangement employing resonant cavities has been proposed. U.S. Pat. No. 4,939,484 (Harada), for example, discloses a through-glass coupler employing a pair of tuned helix cavities. Unfortunately, the liarada cavity aperture must be sized to satisfy a ⅓ object frequency criterion, as described in the patent. That is, for 800 MHz, the helix should be designed for 266 MHz. The resulting cavity has a Q of over 1000 and sufficient coupling aperture. But at the 1.8 GHz band, the helix must be designed for 600 MHz. A 600 MHz helix cavity has a small aperture which is nearly half of the cellular band. A significant drop of unloaded Q is unavoidable due to the thin helix, and the coupling coefficient is not sufficient to provide an 11% bandwidth. Other drawbacks of such helix cavity couplers including highly critical tuning characteristics, and difficulties in mass production due to their complex 3D structure. Impedance matching is also difficult to implement in the cavity context.

In my U.S. Pat. No. 5,471,222, a pair of $TE_{01\delta}$ high dielectric, constant-Q Ba-Bd-Ti oxide (ceramic) resonators were employed to overcome various problems of prior art PCS band through-glass couplers. This approach proved to be highly efficient, with insertion losses of only 0.5 dB through 5 mm automobile glass at 1.8 GHz. However, this arrangement proved sensitive to de-tuning in the field. Additionally, it suffered from a high manufacturing cost.

In my U.S. Pat. No. 5,451,966, a rectangular slot coupling scheme was employed to replace the expensive Ba-Nd-Ti Oxide ceramic. This arrangement built on the concept of dual-cavity coupling, where coupling is through an aperture.

The idea of slot coupling on an MSA (microstrip antenna) originated by Pozar. It provides a means to overcome the narrow band nature generally associated with MSAs. A "doggie bone"-shaped slot suggested by Pozar significantly increases the magnetic polarisability on the slot. This allows a short slot to achieve the necessary coupling while at the same time keeping backward emissions low.

Pozar and other researchers' work was basically limited to numerical solutions of the slot-fed microstrip antenna and multilayer arrays on a ground plane. But the bandwidth advantages of this type of MSA can be used to enhance the performance of the planar slot-cavity coupler.

In my above-referenced pending application, an annular ring aperture is employed for through-glass coupling. It is understood that in the rectangular slot design, the requirement for a tight coupling coefficient leads to an increase in slot length, which increases the level of backwards radiation. A major advantage of the annular ring aperture coupler over rectangular slot coupling is that it provides an increased coupling coefficient, which is extremely valuable for coupling through a thick dielectric wall. Another advantage is that the relatively radial distribution of E field on an annular ring aperture coupler successfully reduces the so-called "Microstrip Antenna Effect" in the rectangular slot approach. The annular ring is the complementary element to a small loop antenna. It is well known that a small loop antenna has a very low radiation resistance, and thus has a very low radiation efficiency. But the reduction of backwards radiation merited the tradeoff. Feeding was accomplished without any transition by connecting a coplanar waveguide line directly to the center resonant element.

More recently, I have improved the annular ring aperture coupler. That design, shown in the attached FIGS. 7A–7D, employs two small circuit boards 201, 202, one of which is single sided. Inside the vehicle, an annular ring 203 is still used, excited by a stub 204. The coaxial feedline (not shown) connects with its center connector soldered to end 205 of the stub, and its shield soldered to foil 206. Plated-through holes 210 connect foil 206 to the groundplane 207 on the opposite side of the inside board 201. On the outside of the vehicle glass, however, the circuit board defines a loaded microstrip 208, to which the whip antenna attaches at end 209. The periphery 211 around the microstrip 208 is foil. A matching function is provided by the microstrip; no additional circuitry is required. The outer surface of the outside circuit board has no foil; just a hole through which the whip antenna connects to end 209.

Some of the evolution in recent high-frequency couplers, and their attendant decrease in transmission loss, is shown by the following:

For Rectangular slot, the transmission loss are accumulated as:

cable---microstrip--- slot---glass---slot---microstrip--- i.m.n.---antenna.

For annular ring aperture coupler, the transmission loss are accumulated as:

cable---microstrip--- annular ring ---glass--- annular ring ---i.m.n.---antenna.

For the most recent work on annular ring, the transmission loss are accumulated as:

cable---microstrip---annular ring---glass--- loaded microstrip--- antenna.(integrated i.m.n.)

Where i.m.n represents impedance matching network.

As evidenced by the foregoing, there are numerous approaches for through-glass coupling at high frequencies. However, such approaches uniformly operate over a single, limited frequency band. The aperture coupled designs probably has the widest bandwidth, but even this is much less than one octave. For AMPS/PCS dual-band operation in the United State, the lowest frequency is 824 MHz and the highest is 1990 MHz, yielding a ratio of 2.415. Even in Europe, the ratio is still 2.112.

In accordance with a preferred embodiment of the present invention, a nonhomogenous quasi-TEM mode transmission line directional coupler arrangement is adapted to serve as a dual-band through-glass coupler. Such a directional coupler has four ports, but two are left open-circuited. By this arrangement, the signal fed by coaxial cable to one port is re-directed across the coupler to the diagonal port, which connects to the external antenna. The even and odd mode impedances of the coupling device are selected so that an over-coupled 3 dB coupler is realized; the two crossover points are located at the centers of the two frequency bands of interest.

This arrangement features very high efficiency since it is a complete distributed design, with no LC circuit elements. Other advantages include its low impedance coupling, and broadband behavior. Moreover, backwards radiation is substantially avoided while maintaining a high coupling coefficient. The coupler is mechanically rugged, easy to manufacture and inexpensive to produce.

A dual-resonant whip antenna or coplanar waveguide dipole type antenna is desirably connected to the coupler, thereby achieving a dual-band glass-mounted antenna system.

The foregoing and other features and advantages will be more readily apparent from the following detailed description, which proceeds with reference to the accompanying drawings.

These objectives are accomplished in the present invention by implementing the quasi-TEM mode transmission line coupler with proper termination, providing an antenna with collinear elements while preserving the performance of the previous arts at the same time.

DETAILED DESCRIPTION

Figure 1:
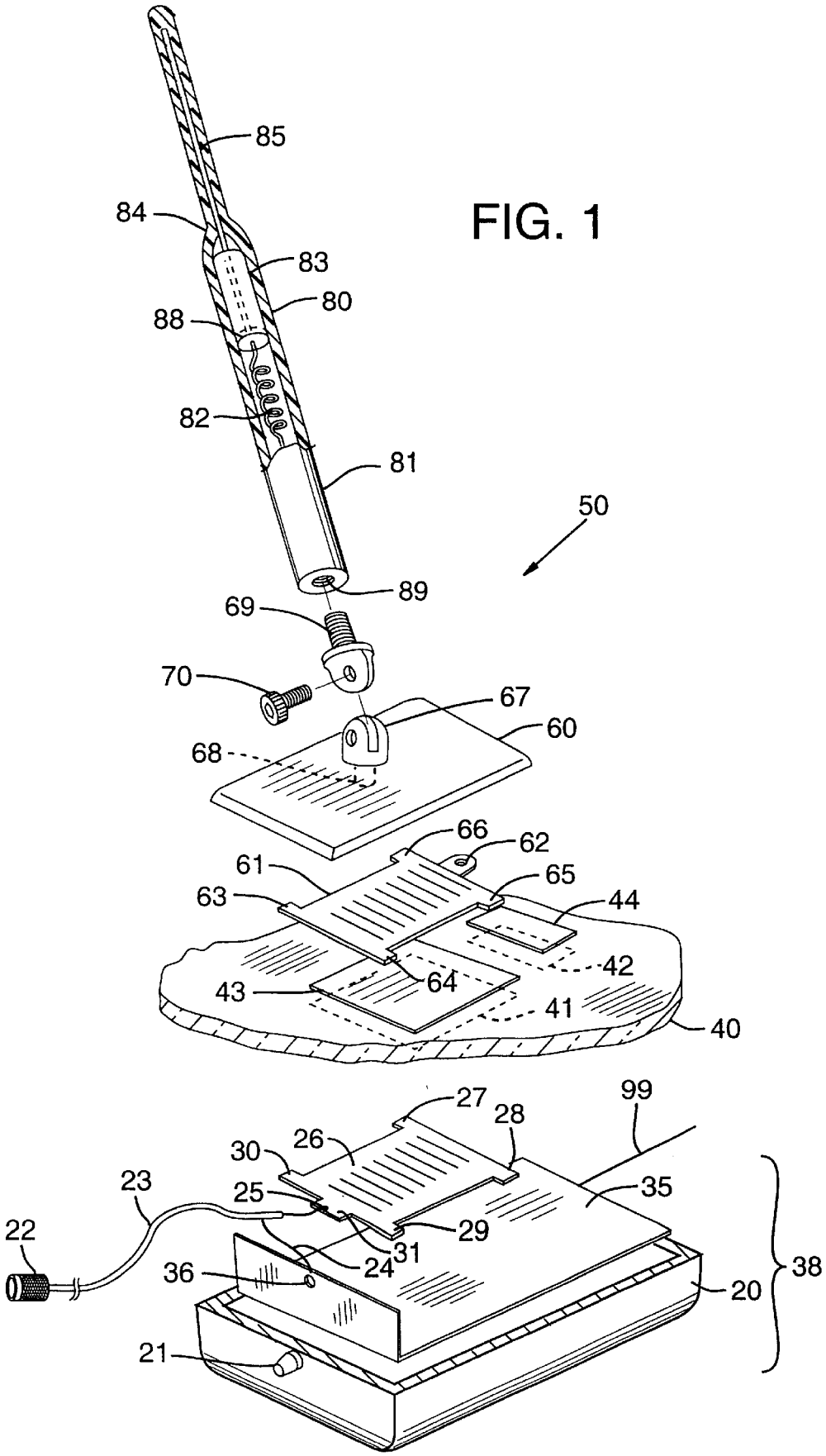
FIG. 1 is a perspective illustration of a dual-band antenna assembly according to a preferred embodiment of the present invention.

FIG. 1 shows an exploded view of a dual-band antenna system according to one embodiment of the present invention.

Outside assembly 60 has the active whip antenna assembly 80 mounted on it. The housing 60 can be made of some thermal plastic materials such as ABS for rigidity and UV stability. Metal swivel part 67 may be insert-molded inside the housing 60 so that it has robust mechanical strength and is moisture isolated. The swivel member 69 and the whip assembly 80 are fixed onto the housing 60 by screw 70. This assembly forms a conductive swivel with a locking mechanism so that the angle of the antenna can be adjusted during the initial installation and subsequent re-adjustment in the field. By providing mating thread 69 and 89 on whip assembly 80 and housing 60, respectively, the whip 80 is detachable for some purpose such as drive-through car wash. The swivel holder member 67 is electrically connected to the edge of outside metal plate member 61 through the extension 62.

A small protrusion 62 from the metal plate member 60 provides an inductive effect which, at 1800 MHz, helps match the capacitive impedance presented by the ⅝ wavelength lower section of the whip 80. Metal plate member 61 is one of the arm of the directional coupler.

Inside assembly 38 comprises a plastic housing 20, a metal plate 26 with approximately the same form as the counterpart of the outside plate 61. Metal plate member 26 is the second arm of the directional coupler. An L-shaped metal piece 35 serves as the common ground plane of the coupler (and serves as a shield preventing backwards radiation). The coupler is fed by a coaxial cable 23 with center conductor 25 connected to the inside plate member 26 through extension 31 and the shield connected to the folded up portion 36 of L shape metal 35. Cable 23 can be any type of popular low loss coaxial cable. The other end of cable 23 is connected to a RF connector 22 which goes to a radio transceiver (not shown).

The inside and outside assembly must be aligned for proper operation. There are two alignment conditions, as follows:

Conductive plates 26 and 61 (on opposite sides of the vehicle glass) must face each other. The plates may be slightly offset (sideways) from one another. Such offset does not impair the directional coupler mode of operation, and provides and additional degree of freedom in tuning the coupler for best impedance match.

The antenna and the feedline must be connected to diagonally opposite ports of the coupler. In the illustrated embodiment, this means that the antenna connects to one edge of one plate, and the feed connects to the remote (opposite) edge of the other plate. In most applications, the inside and outside components of the coupler will be attached by adhesive to opposing sides of the vehicle glass. Once one component is installed, its orientation dictates the orientation at which the other component must be installed. If the inside and outside components are improperly oriented relative to each other, severe mismatch and coupling inefficiency will result.

Figure 2A:
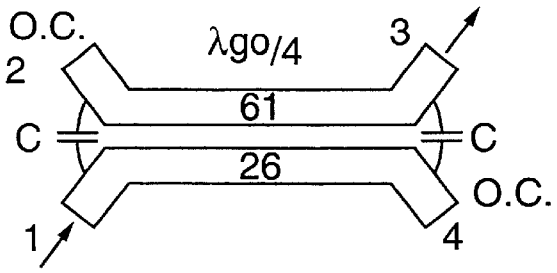
FIG. 2A shows an equivalent circuit for the directional coupler employed in the FIG. 1 embodiment.
Figure 2B:
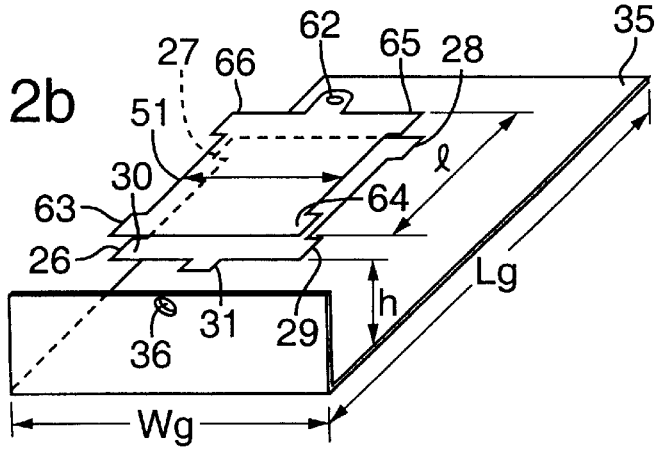
FIG. 2B is another view of the directional coupler employed in FIG. 1
Figure 2C:
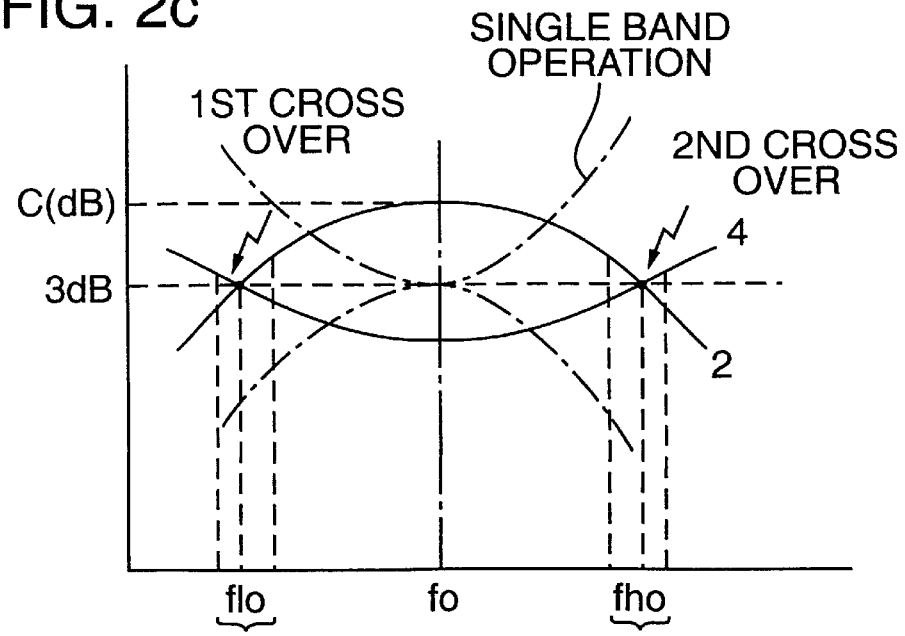
FIG. 2C illustrates the "eye" of the coupling curve that allows two spaced-apart operating bands (or a single operating band, depending on tuning).

Referring to FIGS. 2A and 2C, plates 61 and 26 cooperate to form a quasi-TEM mode directional coupler. This coupler has four ports, although two are left open-circuited and thus are not obvious from inspection of the physical device. One of the open-circuited ports (port 2 in FIG. 2A) is, in physical terms, the edge of plate 61 opposite protrusion 62. The other of the open-circuited ports (port 4 in FIG. 2A) is the edge of plate 26 remote from point 31. (In common parlance, open port 2 is known as the backward coupling port, and open port 4 is known as the through port, although these names are misdescriptive in the present novel use of this coupler.)

The feedline is connected to port 1 in FIG. 2A (generally known as the "input port"). This port is the edge of plate 26 to which terminal 31 connects. The antenna is connected to diagonal port 3 (generally known as the "isolation port). This port is the edge of plate 61 from which protrusion 62 extends.

The illustrated arrangement of open circuits on ports 2 and 4 causes energy to be diagonally coupled between ports 1 and 3.

Figure 6A:
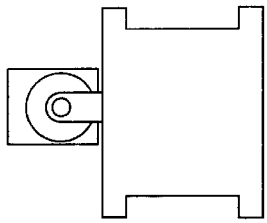
FIGS. 6A and 6B are scale drawings of the first and second plates used in the FIG. 1 embodiment.
Figure 6B:
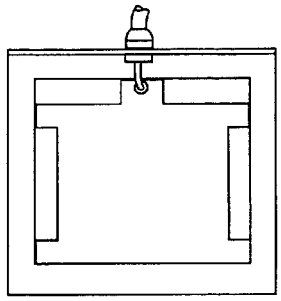
Figure 7A:
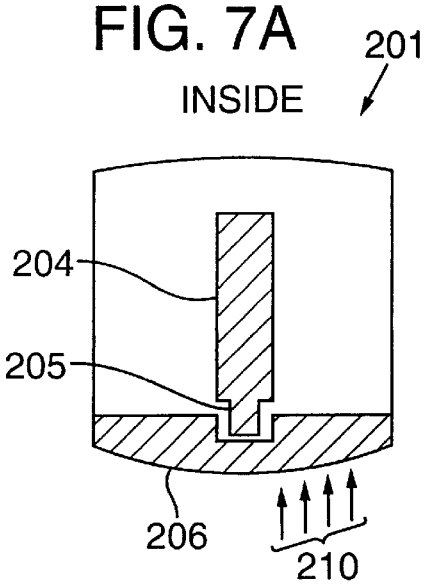
FIGS. 7A–7D show front and back sides of two circuit boards used in the above-described improved annular ring coupler.
Figure 7B:
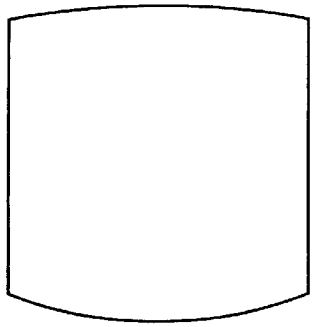
Figure 7C:
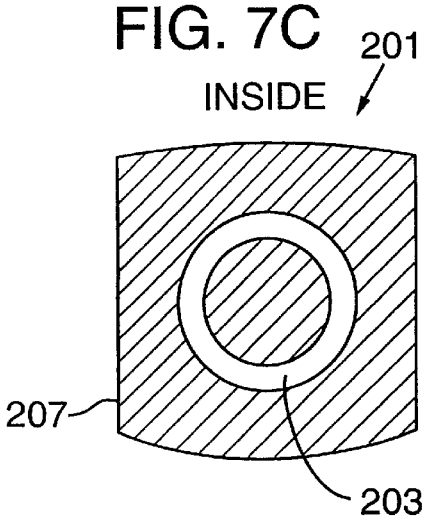
Figure 7D:
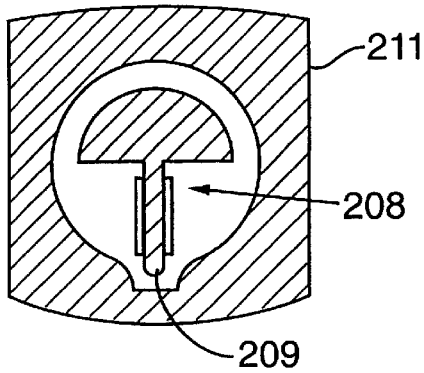

The illustrated coupler is nonhomogeneous, resulting in different even and odd mode phase velocities. To increase the directivity of the coupler, a set of small legs or taps 27, 28, 29, 30, 63, 64, 65, 66 (FIG. 2B, FIGS. 6) are provided on the edges of the inside and outside plates.

The amount of coupling is determined by the distances between the L-shaped metal and the inside plate, the width of the plates, the effective dielectric constant of the window and adhesive assembly and the thickness of the glass and adhesive pads. The operating band is primarily decided by the length of the coupling plate as shown in FIG. 2*b*.

The inside and outside assemblies are mounted onto the vehicle's window through adhesive pads sets 41, 42 and 43, 44, respectively (FIG. 1). Two adhesive patches are employed on each side to permit the planar coupling assemblies to be securely mounted to the (generally) curved vehicle glass. 3M double-sided tape with a thickness of about 1 mm is used in the preferred embodiment. The edges and the open area are desirably sealed by silicone for waterproofing.

It is known that stripline broadside-coupled 3 dB directional couplers have good broadband characteristics. However, once transformed to microstrip, one of the ground planes is removed and the TEM mode changes to quasi-TEM mode. Even and odd mode velocities are different due to the different materials and mode change.

Referring to FIG. 2C, the dual-band operation of the illustrated coupler is based on the fact that the two crossover points are positioned at the center frequency of the desired bands by manipulation of the coupler's coupling C (dB). Coupling C is a function of the dimensions of the coupler and adjacent effective dielectric constant. If C (dB) is intentionally increased (i.e. the coupler is over-coupled) the crossover points spread and can be positioned at the centers of two spaced-apart frequency bands. Alternatively, C can be reduced to about 3 dB to yield single band operation (as shown by the dashed/dot line).

For a 50 ohm system, the standard microwave circuit design procedures detailed below provide a starting point for the coupler's parameters. (Ultimately, empirical testing is required to set final dimensions.)

$$\frac{fh}{fl} = \frac{1920\text{MHz}}{860\text{MHz}} = 2.2326$$

$$f_0 = \frac{824\text{MHz} + 1990\text{MHz}}{2}$$

Any conventional linear simulator can be to get desired coupling value for a strip line model (S. B. Cohn's original coupler)

The next step is to intentionally select an over-coupled C value so that the two crossing points occur at the center frequencies of PCS and AMPS bands, respectively. This can be done graphically. Once C is determined, say −2.5 dB, the coupling coefficient can be obtained.

$$C(\text{dB})=20\log_{10}(K)$$

Then the even and odd mode impedance can be calculated as:

$$Z_{0e} = Z_0\sqrt{\frac{1+K}{1-K}}$$

$$Z_{0o} = Z_0\sqrt{\frac{1-K}{1+K}}$$

Where Z0 is the impedance of the coaxial cable. Then the dimension can be synthesized as follows:

$$Z_{0e} = \frac{\eta_0}{2\sqrt{\varepsilon_{eff}}}\frac{K'(k)}{K(k)}$$

$$Z_{0o} = \frac{296.1}{\sqrt{\varepsilon_{eff}}\,\frac{b_{sl}}{S_{sl}}\tanh^{-1}(k)}$$

Where K'(k) is the Elliptical integrals of the $1^{st}$ kind while k is the solution of equation pairs as follows:

$$\frac{W_{sl}}{b_{sl}} = \frac{1}{\pi}\left[1n\left(\frac{1+R}{1-R}\right) - \frac{S_{sl}}{b_{sl}}1n\left(\frac{1+\frac{R}{k}}{1-\frac{R}{k}}\right)\right]$$

$$R = \sqrt{\frac{kb_{sl}/S_{sl}-1}{b_{sl}/(kS_{sl})-1}}$$

For each k, the Elliptical Integral can be solved numerically, using computer techniques disclosed, e.g., in Press et al, *Numerical Recipes in C*, 2d. ed., Cambridge Univ. Press, 1992.

Iteration has to be performed to fit S. Finally the dimensions of microstrip version coupler can be derived:

$$W = W_{sl}$$

$$S = S_{sl}$$

$$h = \frac{b_{sl} - S_{sl}}{4}$$

The illustrated coupler has a non-homogeneous dielectric, including variously air, adhesive, tape, and window. This dielectric is desirably treated as a thick substrate microstrip line where open end effect must be deducted from the length.

The length of the coupling fingers can be calculated with end effect taken into account:

$$\lambda_{g0}/4 = \frac{C_0}{4\sqrt{\varepsilon_{eff}}\,f_0}$$

$$\delta l(x) = \left(\frac{\xi_1\xi_3\xi_5}{\xi_4}\right)$$

$$\xi_1 = 0.434907\left[\frac{\varepsilon_{eff}^{0.81}-0.26}{\varepsilon_{eff}^{0.81}-0.189}\right]\left[\frac{x^{0.8544}+0.236}{x^{0.8544}+0.87}\right]$$

$$\xi_2 = 1 + \frac{x^{0.371}}{2.358\varepsilon_{eff}+1}$$

$$\xi_3 = 1 + \left[\frac{0.5247\tan^{-1}\left[0.084x^{\frac{1.9413}{\varepsilon 2}}\right]}{\varepsilon_{eff}^{0.9236}}\right]$$

$$\xi_4 = 1 + 0.0377\tan^{-1}[0.067x^{1.456}][6 - 5e^{0.036(1-\varepsilon_{eff})}]$$

$$\xi_5 = 1 - 0.218e^{-7.5x}$$

The coupling arm length for outside and inside couplers are expressed as:

$$l_{outside}=\lambda_{g0}/4-\delta l(W/(h+S))(h+S)$$

$$l_{inside}=\lambda_{g0}/4-\delta l(W/h)h$$

Since no significant difference is observed, the same length is used for the inside and outside coupling plates.

After initial data is calculated, a full-wave numerical simulation can be performed to tweak and optimize the performance since, in reality, the situation is much more complex than the idealized situation modeled by these equations. A Integration Equation Method based MoM (Method of Moment) 3D RF/Microwave structure simulation software IE3D™ (Zeland Software Inc., Fremont, Calif.) is a preferred simulation tool. It has been found that with the folding of the ground plate for adaptation of the coaxial cable, the electrical length of the coupling plates must be reduced to compensate the center frequency shift.

In the preferred embodiment, each coupling plate measures 22 mm by 24 mm, exclusive of the taps. (Suitable performance can be achieved without the taps, particularly at higher frequencies.) The ground plate 35 measures 40 mm (Wg) by 45 mm (Lg), with the cable side folded to form an L-shape so that a coaxial to microstrip transition can be made. The folded-up portion is about 12.5 mm. The spacing between the ground plate 35 and the inside coupling plate is also about 12.55 mm.

In the preferred embodiment, a stub 99 extends from the end of plate 35 opposite the fold to balance the ground current for the lower band since there is no ground plane for the on glass antenna. A 55 mm wire having 1 mm diameter is used in the preferred embodiment.

Back to FIG. 1, the whip assembly 80 is a collinear array type with a single-feeding point provided by coupler output 62. Assembly 80 includes with top radiator elements 85 and 83. Element 83 is a reverse choke which works together with radiator 85 to form a sleeve type of antenna section. Element 83 can be a standard metal tube and measures about ⅝ wavelength for the higher band and has a diameter of about 8.7 mm. Element 83 is open end at the top but is shorted with whip 85 at the bottom. A cylindrical lower radiator member 81 and the swivel members 69, 67 form the lower section of the whip assembly. The two radiators are separated by an air-wounded phasing coil 82. Desirably, coil 82 and whip 85 are formed from a unitary piece of metal (e.g. copper or stainless steel) having a diameter of about 1.8 mm. The whole whip assembly is encapsulated with low loss plastic material, either by a plastic shell or completely molded together.

For the higher frequency band, the radiator member 85 and 83 provide in-phase radiation. The lower section has the same phase as the upper section by means of the phasing coil 82. Therefore at least 2.5 in-phase dipoles are furnished for the higher band. The feed impedance on the higher band is close to a ⅝ radiator due to the current distribution. This capacitive reactance is countered by the inductance provided by protrusion 62 from plate 61, as mentioned earlier.

For the lower frequency band, the inductance of stub 62 is negligible. Upper radiators 85 and 83 are still in phase since these elements cooperate to define a reverse choke. The phase starts reversing at the upper to middle section of the lower radiator 81 and increases along the bottom, making it a "current-fed antenna" with an impedance of about 50 ohms. Considering the proportion of the current distribution, it still has strong low angle radiation but the pattern splits at about 15 degrees of elevation angle.

Whip 80 thus provides a collinear dual band array that is current-fed at the lower frequency band and voltage fed at the higher frequency band, thereby facilitating relative independent tuning.

As stated earlier, the coupler employed in FIG. 1 can be designed to provide single band operation, if desired. Such a coupler is advantageous due to its simplicity and efficiency, whether at 800 MHz, 1800 MHz, or elsewhere.

The coupling factor C in dB for a single-band operation is selected either the way that maximum coupling occurs at the center of desired band or the way in a dual-band design described previously. There is always a trade-off between size and which crossover portion being used. For example, C=−2.9 dB results in a more than 10% bandwidth.

Figure 3:
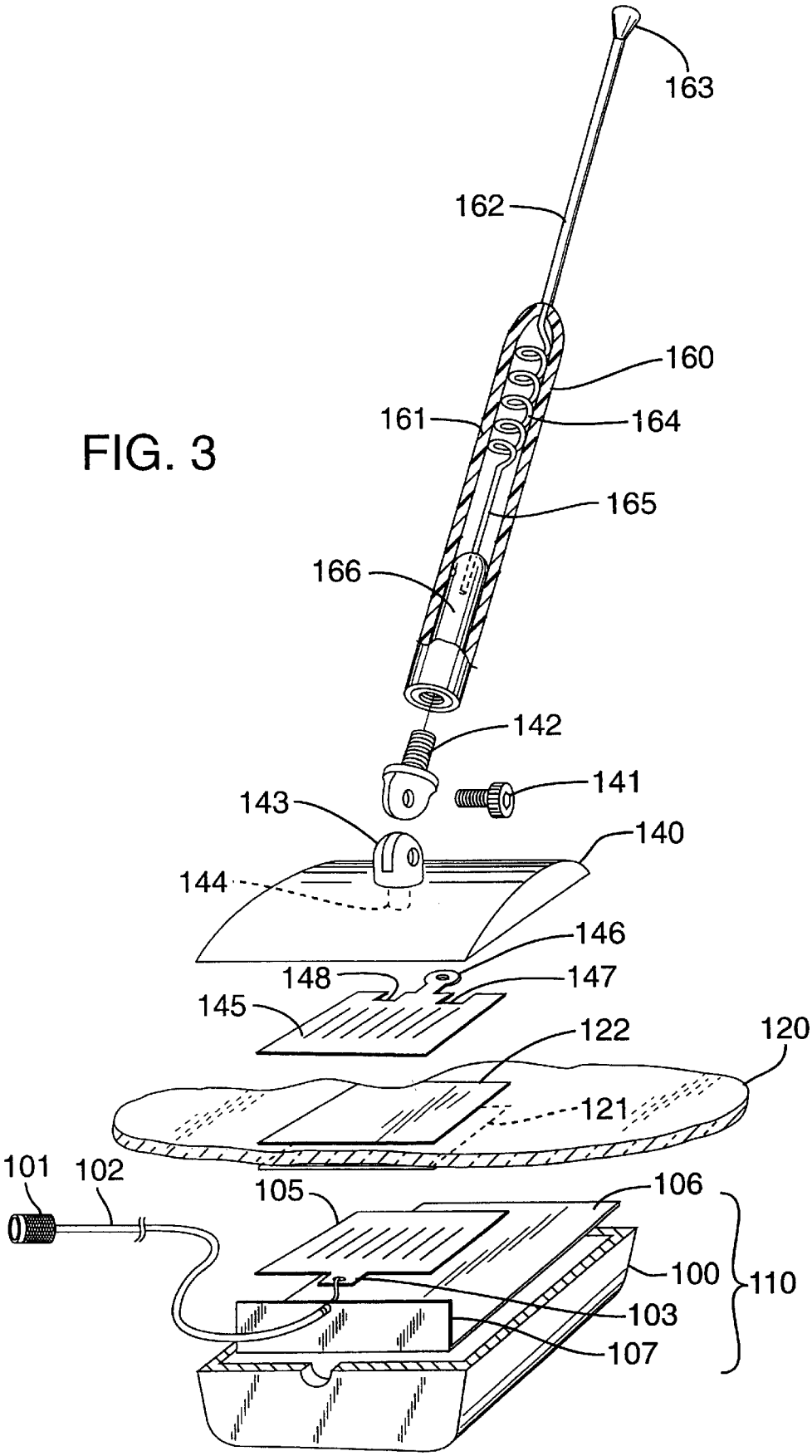
FIG. 3 is a perspective illustration of a single band antenna system according to a second embodiment of the present invention.

FIG. 3 shows the detailed construction of the single band PCS/PCN antenna system. The coupler plates are the same for higher frequency band since the $2^{nd}$ crossover is available. The whip assembly 160 can be a ½ wavelength whip section 162 stacked over a ⅝ wavelength section (165, 166, 142, 143) through a 180 degree phasing coil 164. Again the coil is encapsulated for environmental reasons. The extension 146 of the outside plate 145 serves as an inductor for the matching of ⅝ wave base section. Notches 147 and 148 on the outside plate 145 can effectively reduce the size of the inductance 146 trace length.

One advantage of the illustrated coupler is that a virtual ground plane can be provided outside the vehicle glass. This facilitates use with elevated-feed antennas, such as sleeve dipoles.

Figure 4:
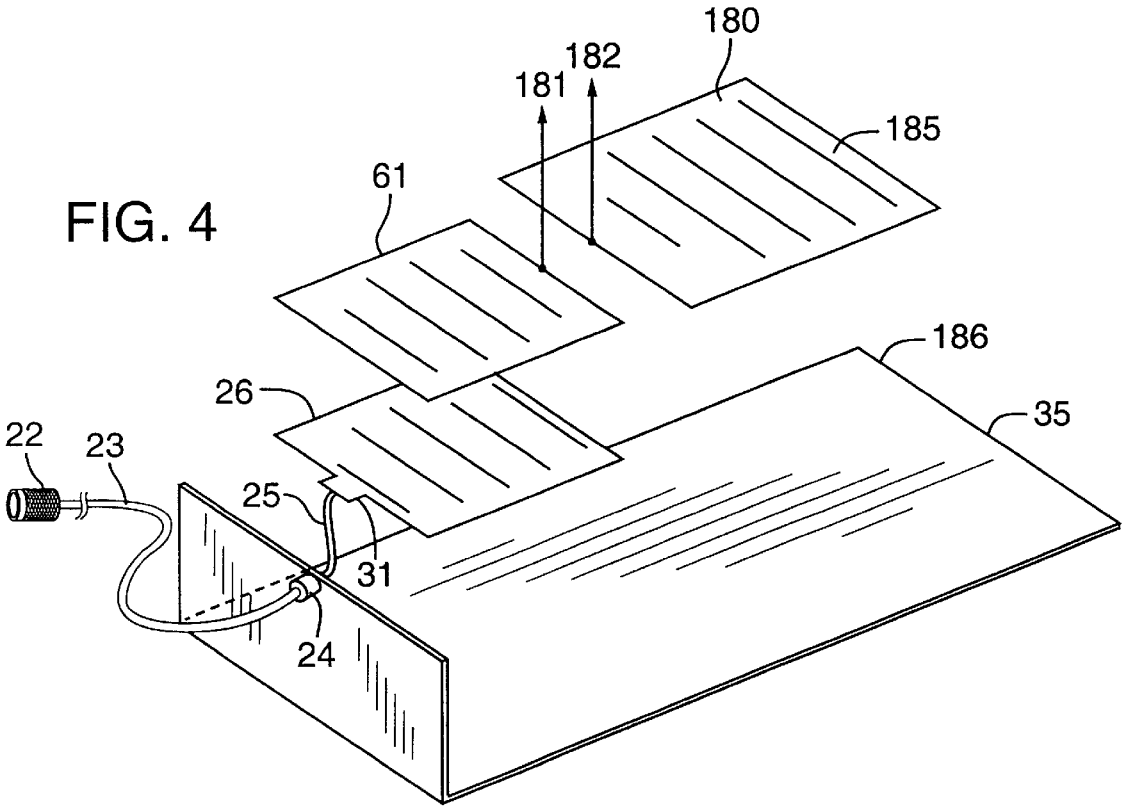
FIG. 4 illustrates another embodiment of the present invention wherein an elevated-fed antenna driven by use of a virtual ground plane.

Referring to FIG. 4, the ground plate 35 is extended lengthwise to underlie another metal plate 180 outside the window. Edges 185 and 186 are aligned together. The additional patch 180 is placed aside the main coupling plate 61. The outside plate 180 and the inside extended plane 35 are separated by the window. If a ¼ wavelength dimension is selected for the outside plate 180 and the ends are open, edge 182 of outside plate 180 is the short circuit due to the quarter-wave transformation. Therefore a "virtual ground point" is realized at this point. An elevated-fed antenna can be fed between this edge 182 and the coupler edge 181. At least one band can be covered for high feeding point or a compromised performance for dual-band operation.

Figure 5A:
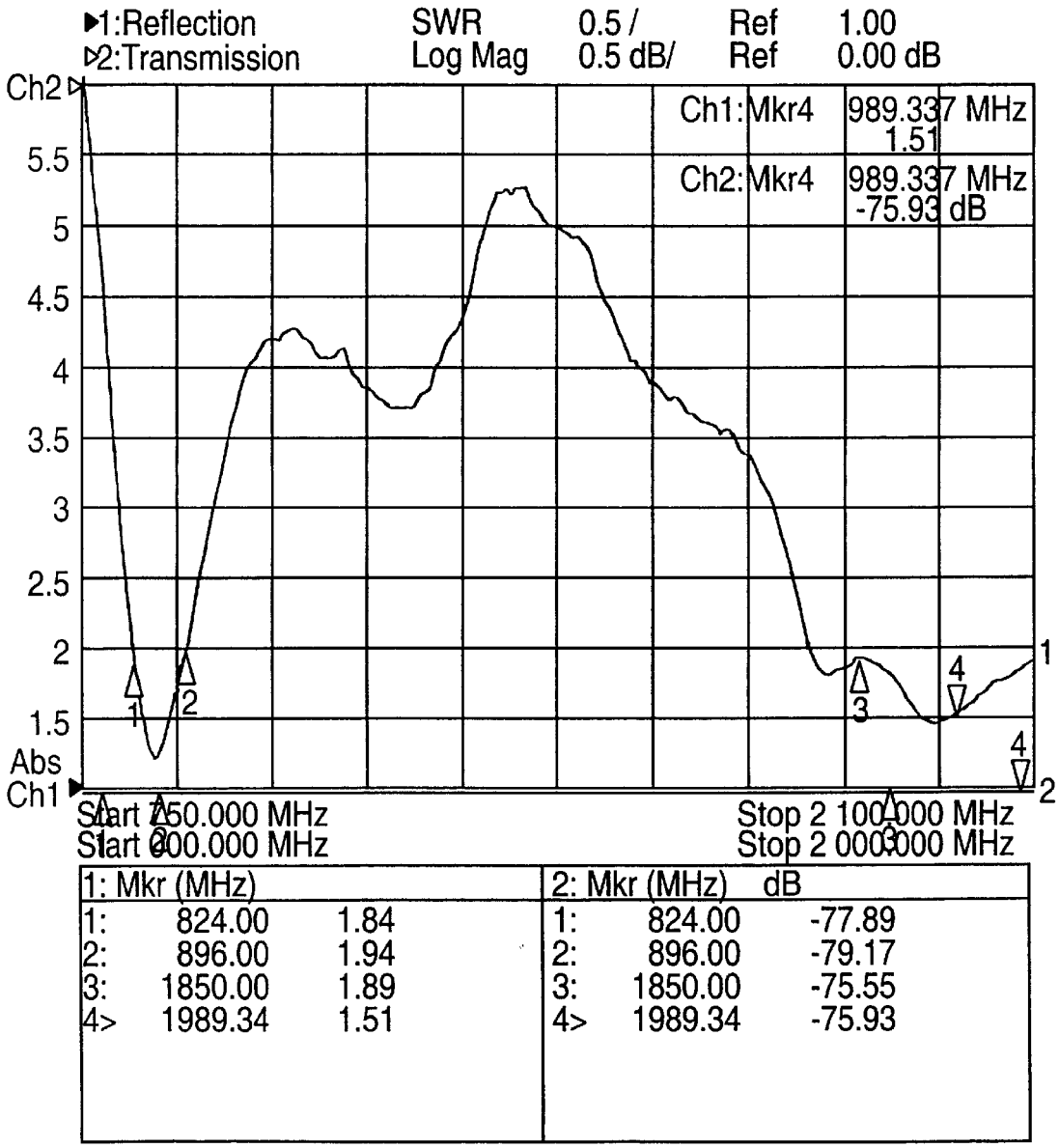
FIG. 5*a* is a plot showing the typical VSWR characteristics of the antenna system of FIG. 1.
Figure 5B:
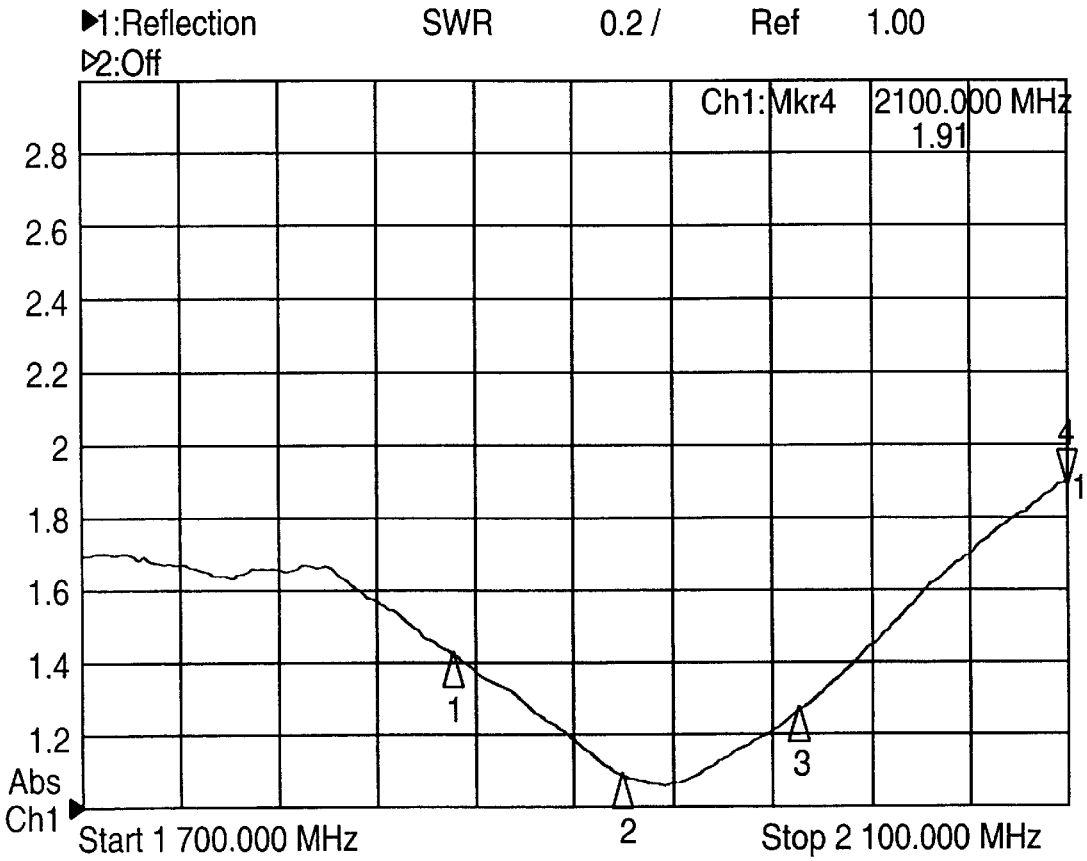
FIG. 5*b* is a plot showing the typical VSWR characteristics of the antenna system of FIG. 3.

FIG. 5*a* shows the typical VSWR of the dual-band antenna system of FIG. 1. FIG. 5*b* is a similar plot but for the single band antenna system of FIG. 3.

While the foregoing discussion has described the conductive plates as being metal sheets, in other embodiment circuit board implementations can naturally be used. Likewise, while the whip antenna has been shown as being wire based, the whip, too, can be fabricated as a blade using a planar etched printed circuit.

Having described and illustrated the principles of my invention with reference to a preferred embodiment, and various alternatives thereof, it should be apparent that my invention can be modified in arrangement and details without departing from such principles.

Accordingly, I claim as my invention all such modifications as may come within the scope and spirit of the following claims, and equivalents thereto:

1. A dual band antenna for mounting on glass comprising:

a radiator;

a directional coupler comprising first and second conductive structures, the first conductive structure located on a first side of the glass, the second conductive structure located on a second side of the glass, said coupler defining four ports, two of said ports in diagonal relationship being left unterminated, a third port being coupled to the radiator, and a fourth port being coupled to a feedline.

2. The antenna of claim 1 in which the antenna is resonant in two frequency bands that are non-contiguous.

3. The antenna of claim 2 in which the antenna is resonant at first and second frequencies, the second frequency being at least twice the first.

4. The antenna of claim 1 in which the antenna is resonant in both the 800 MHz band, and also in the 1800 MHz band.

5. The antenna of claim 1 in which the directional coupler operates in an overcoupled, quasi-TEM mode.

6. In a mobile antenna assembly adapted for mounting on a glass member, the assembly including a whip antenna, an outside coupling component, and an inside coupling component, the whip antenna being mounted to the outside coupling component, the outside coupling component being adapted for mounting adjacent an outer surface of said glass member, the inside coupling component being adapted for mounting adjacent an inner surface of said glass member approximately opposite said outside coupling component, an improvement wherein the outside and inside coupling components cooperate to form a directional coupler to thereby effect electromagnetic coupling through said glass member.

7. The antenna assembly of claim 6 in which the assembly is resonant in two frequency bands that are non-contiguous.

8. The antenna assembly of claim 7 in which the assembly is resonant at first and second frequencies, the second frequency being at least twice the first.

9. The antenna assembly of claim 6 in which the assembly is resonant in both the 800–900 MHz band, and also in the 1800–1900 MHz band.

10. The antenna assembly of claim 6 in which the coupler operates in a quasi-TEM mode.

11. An antenna system comprising a coupler for use in coupling RF from a feedline, through an intervening dielectric, and to an antenna element, the coupler comprising:

a first planar metal member positioned adjacent a first side of the dielectric, and having first and second ends;

a second planar metal member positioned adjacent a second side of the dielectric, and having first and second ends;

said first and second planar metal members substantially overlaying each other, with the respective first ends proximate each other, and the respective second ends proximate each other;

a first connection at the first end of the first planar metal member for connection to the feedline; and a second connection at the second end of the second planar metal member for connection to the antenna element.

12. The antenna assembly comprising the coupler of claim 11 wherein said antenna element is a dual-band antenna element.

13. The antenna assembly of claim 12 in which the assembly is resonant at first and second frequencies, the second frequency being at least twice the first.

14. The antenna assembly of claim 12 in which the antenna assembly is resonant in both the 800 MHZ band, and also in the 1800 MHZ band.

15. The coupler of claim 11 wherein the antenna element connects to the second end of the second planar member through a planar inductive element, said inductive element being integrally formed with the second planar member and extending therefrom.

16. The coupler of claim 11 in which at least one of said planar metal members has one or more taps extending therefrom.

17. The coupler of claim 11, further including an L-shaped metal member having a long portion and a short portion, the long portion being disposed parallel to said first and second planar metal members and having a connection point along the short portion for coupling to a shield conductor of a coaxial feedline.

18. The coupler of claim 17, further including a metal stub extending from the long portion of the L-shaped metal member.

19. An antenna system including a radiator and a coupler for use in coupling RF from feedline having two conductors, through an intervening dielectric, and to two output conductors, the coupler comprising:

a first metal member positioned adjacent a first side of the dielectric;

a second metal member positioned adjacent a second side of the dielectric, approximately opposite the first metal member;

a third metal member having a planar portion overlaying, and extending beyond, and spaced apart from the first member by a dielectric;

a fourth metal member positioned adjacent the second side of the dielectric and next to the second metal member, the fourth metal member being approximately opposite the extended planar portion of the third metal member;

the two conductors of the feedline connecting to the first and third metal members;

the two output conductors comprising the second and fourth metal members.

20. The antenna system of claim 19 wherein the radiator comprises an elevated feed antenna coupled to the two output conductors.

* * * * *

UNITED STATES PATENT AND TRADEMARK OFFICE

CERTIFICATE OF CORRECTION

PATENT NO. : 6,172,651 B1
DATED : January 9, 2001
INVENTOR(S) : Xin Du

It is certified that error appears in the above-identified patent and that said Letters Patent is hereby corrected as shown below:

Title page,
The Primary Examiner's name should be changed from "Weng" to -- Wong --,
U.S. PATENTS DOCUMENTS, the inventor of Patent No. 4,939,524, registered 7/1/1990, should be changed from "Blasese" to -- Blaese --, Column 1,
Line 34, "MHz.)." should be changed to -- MHz.) --.
Line 37, "effort" should be changed to -- efforts --.

Column 2,
Line 24, "Mhz" should be changed to -- MHz --,
Line 47, "liarada" should be changed to -- Harada --, Column 4,
Line 10, "State," should be changed to -- States. --.
Line 54, "FIG. 1" should be changed to -- FIG. 1. --.

Column 5,
Line 31, "the arm of" should be changed to -- the arms of --.
Line 52, "and" should be changed to -- an --.

Column 6,
Line 15, "port)." should be changed to -- port"). --.

Column 7,
Line 8, "can be to get" should be changed to -- can be used to get --.
Line 9, "coupler)" should be changed to -- coupler). --.
Line 29, "Z0" should be changed to -- $Z_0$ --.

Column 8,
Line 58, "includes with" should be changed to -- includes --.

UNITED STATES PATENT AND TRADEMARK OFFICE

CERTIFICATE OF CORRECTION

PATENT NO. : 6,172,651 B1
DATED : January 9, 2001
INVENTOR(S) : Xin Du

It is certified that error appears in the above-identified patent and that said Letters Patent is hereby corrected as shown below:

Column 10,
Lien 14, "thereto:" should be changed to -- thereto. --, as

Signed and Sealed this

Eleventh Day of June, 2002

*Attest:*

*Attesting Officer*

JAMES E. ROGAN
*Director of the United States Patent and Trademark Office*